US005447603A

United States Patent [19]

Michalowski et al.

[11] Patent Number: 5,447,603

[45] Date of Patent: Sep. 5, 1995

[54] PROCESS FOR REMOVING METAL IONS FROM LIQUIDS

[75] Inventors: Robert J. Michalowski, Midland, Mich.; Steven H. Christiansen, Waianae, Hi.; R. Keith Frank; Teresa Littleton, both of Lake Jackson, Tex.; Jaime Simon, Angleton, Tex.; Walter Vaughn, Lake Jackson, Tex.; David A. Wilson, Richwood, Tex.

[73] Assignee: The Dow Chemical Company, Midland, Mich.

[21] Appl. No.: 89,354

[22] Filed: Jul. 9, 1993

[51] Int. Cl.[6] ..... D21H 17/67

[52] U.S. Cl. ..... 162/181.4; 162/181.5

[58] Field of Search ..... 162/78, 79, 181.2, 181.3, 162/181.4, 181.5, 181.6, 181.8

[56] References Cited

U.S. PATENT DOCUMENTS

| | | | |
|---|---|---|---|
| 1,870,881 | 4/1931 | Thomsen . | |
| 2,241,235 | 8/1939 | Bachman . | |
| 2,711,371 | 6/1955 | Lurie | 162/181.3 |
| 2,918,399 | 12/1959 | Eichmeier | 162/181.6 |
| 3,090,705 | 5/1963 | Miksits | 162/181.4 |
| 3,232,697 | 2/1966 | Needleman . | |
| 3,312,665 | 4/1967 | Caldwell et al. . | |
| 3,313,779 | 4/1967 | White . | |
| 3,639,206 | 2/1972 | Spruill . | |
| 3,679,621 | 7/1972 | Morf et al. . | |
| 3,736,254 | 5/1973 | Croom . | |
| 4,115,188 | 9/1978 | O'Brien et al. . | |
| 4,133,929 | 1/1979 | Bowes et al. . | |
| 4,166,002 | 8/1979 | Lehmann et al. . | |
| 4,200,735 | 4/1980 | Sano et al. . | |
| 4,347,099 | 8/1982 | De Ceuster et al. . | |
| 4,388,150 | 6/1983 | Sunden et al. . | |
| 4,392,979 | 7/1983 | Lee et al. . | |
| 4,419,246 | 12/1983 | Jayawant . | |
| 4,446,201 | 5/1984 | Lee et al. . | |
| 4,477,367 | 10/1984 | Burba, III . | |
| 4,549,929 | 10/1985 | Tay et al. | 162/79 |
| 4,599,138 | 7/1986 | Lindahl . | |
| 4,661,634 | 4/1987 | Vaughn et al. . | |
| 4,664,843 | 5/1987 | Burba, III et al. . | |
| 4,692,209 | 9/1987 | Santên et al. . | |
| 4,747,954 | 5/1988 | Vaughn et al. . | |
| 4,747,957 | 5/1988 | Vaughn et al. . | |
| 4,753,710 | 6/1988 | Langley et al. | 162/181.8 |
| 4,766,036 | 8/1988 | Vaughn et al. . | |
| 4,846,978 | 7/1989 | Leggett et al. . | |
| 4,990,268 | 2/1991 | Burba, III et al. . | |
| 5,015,409 | 5/1991 | Read, Jr. et al. . | |
| 5,039,377 | 8/1991 | von Raven et al. | 162/78 |
| 5,039,428 | 8/1991 | Wentzler et al. . | |
| 5,084,209 | 1/1992 | Burba, III et al. . | |
| 5,194,120 | 3/1993 | Peats et al. | 162/181.6 |
| 5,223,098 | 6/1993 | Cluyse et al. | 162/181.2 |

FOREIGN PATENT DOCUMENTS

| | | | |
|---|---|---|---|
| 816631 | 7/1959 | United Kingdom | 162/181.5 |
| 1033617 | 8/1983 | U.S.S.R. | 162/181.6 |
| 1147805 | 3/1985 | U.S.S.R. | 162/181.6 |

OTHER PUBLICATIONS

*Kirk–Othmer Encyclopedia of Chemical Technology*, vol. 16, Third Edition, "Paper", pp. 768–802, John Wiley & Sons, (1979).

(List continued on next page.)

*Primary Examiner*—Peter Chin

[57] ABSTRACT

The invention is an improvement in a process for making cellulosic articles said process involving a separation of cellulosic material from a mixture containing a liquid, metal cations, and cellulosic material. The improvement involves adding to the mixture at least one retaining material which binds at least one metal cation and, in the separation, is retained with the cellulosic material. Suitable retaining agents are either organic or inorganic and include chelate-forming polymers, both synthetic and natural, colloidal suspensions of inorganic compounds, and mixed metal hydroxides. In each case, the metal cations remain in the cellulosic article, e.g. paper, rather going into waste water from which they would otherwise need to be removed.

11 Claims, No Drawings

OTHER PUBLICATIONS

*Kirk-Othmer Encyclopedia of Chemical Technology,* vol. 5, Third Edition, "Chelating Agents", pp. 339-368, John Wiley & Sons, (1985).

*Encyclopedia of Polymer Science and Engineering,* vol. 3, "Chelate-Forming Polymers", pp. 363-381, John Wiley & Sons, (1981).

*Kirk-Othmer Encyclopedia of Chemical Technology,* vol. 19, Third Edition, "Pulp", pp. 339-368, John Wiley & Sons, (1982).

*Kobunshi, Ronbunshu Eng.,* vol. 32(4), "Properties of Chelate Polymers Containing Ethylenediaminetetraacetic Acid Structure", pp. 225-228, M. Ueda et al., (1975).

*Tappi,* vol. 63(4), "Optimized hydrogen peroxide bleaching in closed white-water systems", pp. 111-114, Rolf Anderson et al., (1980).

*Talanta,* vol. 21, "Some Chelating Ion-Exchange Resins Containing Ketoiminocarboxylic Acids as Functional Groups", pp. 751-763, M. Marhol et al., (1974).

*3. Anal. Chem.,* vol 236, "Le rôle et l'utilisation de la complexation", pp. 473-499, B. Tremillon, (1968).

*Angew. Makromol. Chem.,* "Selective Ion Exchange Polymers*", pp. 171-191, A. Warshawsky, (1982).

*Pure Appl. Chem.,* vol. 44, "The Influence of Natural and Synthetic Ligands on the Transport and Function of Metal Ions in the Environment", pp. 81-113, A. E. Martel, (1975).

*Coordination Chemistry Reviews,* vol 59, "Coordination Chemistry of Chelating Resins and Ion Exchangers", pp. 1-139, S. K. Sahni et al., (1984).

PROCESS FOR REMOVING METAL IONS FROM LIQUIDS

This invention relates to forming articles from cellulosic material, more particularly to separating metal ions from liquids used in forming such articles.

Paper making is a common example of forming articles from cellulosic pulp and is used as an illustration of this invention, but the invention is not limited thereto. The invention is also useful in fiber board processes, textiles processes, non-woven processes, and the like.

The effect of metal ions such as iron, copper and manganese, which are minor components of wood, on cellulosic pulp has long been recognized. These metals increase the amount of colored structures in pulp and promote a metal-catalyzed decomposition of peroxides frequently used to bleach pulp. Chelants such as diethylenetriaminepentaacetic acid (DTPA) and ethylenediaminetetraacetic acid (EDTA) are used to sequester metal ions so that they can be controlled or removed from the pulp into the white water. The effects and removal of such ions are discussed for instance in Anderson et al., Tappi Vol. 63, No. 4, April 1980, pp. 111–114. However, when these chelants are used, the chelated metals go into waste water. If the water is recycled, the concentration of metals increases and their deleterious effects also increase. When the "white water" from paper making, for instance, is recycled the metal ion concentration increases such that controlling the metal ions with chelants becomes relatively ineffective or requires very large amounts of chelants.

In processes such as paper making, pulp is slurried in water and the slurry is filtered by use of a screen from which water can be drained or pressed. The water which is drained contains some small fibers which are not retained by the screen (referred to as fines) and also contains fillers such as clay as well as the sequestered metal ions. Such water is called "white water". The white water is often re-used for dilution of incoming pulp, especially in closed paper making systems. In such systems, the fines, fillers, metal ions are returned to the pulp where their effects are evident. As concentration builds it becomes necessary to remove these from the white water.

Several methods have been proposed for removing chemicals from white water. In one such method, taught in U.S. Pat. No. 4,692,209 (Santen, et al.), a waste liquid from pulp production is purified by feeding it into a reaction zone where it is vaporized with heat. Inorganic chemicals are withdrawn as a liquid melt or solution while organic constituents are removed as a synthesis gas. The process of U.S. Pat. No. 4,388,150 (Suden et al.) is directed more precisely to purifying waste white water. A composition of colloidal silicic acid and cationic starch is added to the white water to reduce pollution problems and or recover materials from the white water. Alternatively, the composition is added to the paper as a binder. In the teachings of U.S. Pat. No. 1,870,881 (Thomsen) a zinc salt is added in a paper making process and goes into the white water. The white water is treated with lime, allowed to settle and solids removed by filtration, then is added to subsequent pulp and said to become enmeshed in the resulting deckered stock or final paper.

Several other methods for removing impurities from white water involve use of inorganic calcium compounds. Such methods include removal of color bodies, which are said to be considered by some to include calcium ions reacted with lignin by-products, by treating the water with lime and mud (principally calcium carbonate), followed by clarification separation of precipitants and treatment of the remaining liquid with carbon dioxide as taught in U.S. Pat. No. 3,736,254 (Croom). Another process for removing color bodies taught in U.S. Pat. No. 3,639,206 also uses calcium compounds, namely calcium oxide and hydroxide to reduce color followed by carbon dioxide to precipitate remaining calcium. The process taught in U.S. Pat. No. 4,115,188 (O'Brien) involves treatment with sulfuric acid to lower the pH followed by calcium hydroxide to separate coagulated solids which may be used as landfill, low grade pulp or fuel. In the teachings of U.S. Pat. No. 4,419,246 (Jayawant) heavy metal ions bonded to complexing agents are precipitated from waste water using a combination of a magnesium ion, calcium hydroxide and a peroxygen compound. An alkaline treatment stage in a process taught in U.S. Pat. No. 5,309,428 (Wentzler et al.) can also use calcium hydroxide. In that process different sized particles are formed, the larger ones separated and the fines recycled to the precipitation stage.

There are additionally a number of methods of removing metal ions from liquids, but these are not generally used for white water. One reason such methods are often inapplicable is that generally the metal ions have been chelated to reduce their effects on the pulp and the bleaching process. Chelated ions are difficult to remove. Ozonation is sometimes recommended to remove chelated metals from solution, and U.S. Pat. No. 4,846,978 teaches that magnesium hydroxide is advantageously used before ozonation.

A few of the known methods of removing metal ions do however involve adsorbing or absorbing the metal ions onto certain fibrous materials. In the process taught in U.S. Pat. No. 4,747,954 (Vaughn, et al.), fibers of ethylene/carboxylic acid copolymers and terpolymers are used, preferably in a porous form but optionally in a fibrous form, to remove metals from liquids. In the process taught in U.S. Pat. No. 4,133,929 (Bowes, et al.), a cellulosic material has at least one chelant form of amino acid group and is used for removing contaminants from solution in aqueous and/or organic liquids. In the process taught in U.S. Pat. No. 4,200,735 (Sano, et al.) a cellulosic ion exchange fiber is used. In the process taught in U.S. Pat. No. 3,313,779 (White) a resin with aldehyde chelating groups is used.

All of these processes would require a step of removal and disposal of the fibrous material as well as absorption or adsorption of the metal ions onto the materials.

It would be desirable to have a process for preparing cellulosic articles in which the metal, ions would not go into the waste water in either a chelated or unchelated form, and preferably one in which the materials used to remove the ions required no separation or disposal.

SUMMARY OF THE INVENTION

The present invention includes an improvement in a process for making cellulosic articles said process involving a separation of cellulosic material from a mixture comprising liquid, metal ions, and cellulosic material. The improvement comprises admixing with the liquid and the cellulosic material at least one retaining material which binds to at least one metal ion and, in the separation, is retained with the cellulosic material.

Stated otherwise, the invention includes a process comprising separating a mixture containing cellulosic material, retaining material and metal ions bound thereto from a mixture containing liquid, metal ions, cellulosic material, and a retaining material which binds to metal ions. The invention also includes cellulose articles (for instance, paper) having therein such retaining materials including certain synthetic polymers, cellulose derivatives, mixed metal hydroxides and/or inorganic suspensions, said retaining materials preferably being at least partially bound to metal ions.

Cellulosic articles containing the retaining material and resulting bound metal ions are additional aspects of the invention.

Such a process allows the metal ions to be separated from the liquid before the liquid becomes part of a waste stream. Therefore, the metal ions do not need to be removed from the waste. Preferably, the metal is retained in the pulp material in such a form that it does not undesirably affect the optical brightness or color of the pulp material or other physical properties thereof.

DETAILED DESCRIPTION OF THE INVENTION

This invention is applicable to any cellulosic material. The term cellulosic material is used to refer to any material comprising cellulose whether obtained by chemical process or mechanical process or combinations thereof. Such materials include pulps such as chemical (e.g. kraft process), thermomechanical, mechanical, chemimechanical, chemithermomechanical or ground pulp and fibers contained therein. In chemical pulps, the wood or other cellulose source is advantageously separated into pulp with the help of sulfate or sulfite materials. In mechanical and thermomechanical processes, pulp is separated by grinding or otherwise disintegrating the cellulose source. Hardwood and softwood pulps and mixtures thereof are suitable for the practice of the invention as are pulps obtained from cotton, bagasse, esparto, hemp, kenaf and the like. This invention is particularly suited for bleached pulps of either a chemical or mechanical process.

The process of the invention is suitably incorporated into any process for preparing any cellulosic articles which involves the separation of a liquid from the cellulosic material. Such processes include processes for making paper fiber board, textile, and nonwovens and the like. Paper making is exemplary of such a process and involves separation of the white water from a pulp sheet. The process of the invention is useful, for example, in paper making processes which include kraft, mechanical, chemimechanical, thermochemimechanical, stone ground and bleached sulfite processes. While a paper making process is used to illustrate the invention, the invention is applicable in any process of separating cellulosic material from a liquid wherein metal ion control is desirable.

Suitable conditions for the process of the invention include any conditions under which the retaining materials are active. Temperature and pressure are not critical in the practice of the invention. Temperatures typically encountered in paper making processes generally range from about 25° C. to about 100° C. Ranges of pH encountered in sour pulp processes (e.g. about pH 4–4.5) and bleached pulp processes (e.g. about pH 10–11) are generally suitable, particularly for exposure during the making of the cellulosic articles, but a pH close to neutral, e.g. about 5–9, is more preferable for contact of the retaining material with the metal ion.

Retaining materials suitable for use in the practice of the invention include any material which will be retained in the cellulosic pulp mass and which is effective in binding metal ions. To be retained with the cellulosic material, the retaining material is advantageously insoluble in a liquid to be separated from the cellulosic material. A material is considered to bind metal ions if it in any way attracts or becomes attached to a metal ion (e.g. by bonding either covalent, coordinate or ionic or by electrostatic attraction) such that metal ion stays with the material rather than going into the surrounding medium (preferably liquid, more preferably water). These retaining materials include both organic and inorganic materials. Among organic retaining materials, chelating materials are preferred. Among inorganic materials, colloidal suspensions and mixed metal hydroxides capable of binding metal ions present in the cellulosic material at the pH and temperature encountered in a particular process as previously discussed are preferred.

A chelating agent is a compound having donor atoms that can combine via coordinate bonding with a metal ion to form a cyclic structure called a chelate. A chelating material has two or more atoms which form coordinate bonds with the metal ion. The coordinating atoms are electron donors and the metal atoms accept electrons. Functional groups having such atoms are referred to herein as chelating ligands. When the bond is formed, the metal ion and two donor atoms of the chelating material complete a ring structure that gives the chelate its character. A chelating compound can be a neutral molecule or a positive or negative complex ion. Thus the chelating material can be acidic or basic, but in the practice of the invention the material is preferably acidic. Chelating ligands are known to those skilled in the art and are exemplified in such references as *Kirk-Othmer Encyclopedia of Chemical Technology,* 3rd ed., vol. 5, N.Y. pp. 339–368, (1979).

To be retained with the pulp mass, the chelating material used in practice of the invention is preferably a polymer. Such polymers are referred to as chelate-forming polymers and are polymers that have chelating ligands. Most commonly the chelating ligands are attached at one point on a polymer molecule. However in the practice of the invention it is also suitable to use polymers which have groups which will form coordinate bonds with the metal ion, said groups being on different portions of the polymer molecule but which result in formation of a ring when coordinately bonded to the metal atom. It is also suitable to use polymers having atoms suitable for coordinate bonding such that the metal ions form coordinate bonds with groups on more than one polymer molecule and thus form a type of cross-linking between the molecules. These types of chelate-forming polymers are discussed in detail in the *Encyclopedia of Polymer Science and Engineering,* Vol. 3, pp. 363–381, (1985).

The term "polymer" as used herein refers to any material having repeating molecular units, including an oligomer. Polymers suitable for use in the practice of the invention are of sufficient molecular weight to be retained in the cellulosic material rather than dissolved in the liquid separated therefrom.

Chelate-forming polymers may have various types of chelate forming functional groups. Among these are iminodiacetic acid derivatives, thioureas, crown ethers, and 1,3-dicarbonyl compounds. In the practice of the invention, it is most preferable to use chelate-forming polymers which have carboxylic acid functional groups e.g. those found in the iminodiacetic acid derivatives. Such groups are useful in chelating most multivalent metals such as those commonly found in wood pulp. Some of the other groups are somewhat more specialized but useful when particular ions are found in a cellulosic material or are otherwise introduced into a mixture of cellulosic material and liquid.

The polymer is optionally a synthetic polymer or a natural polymer which has been modified to include at least one chelating group. Such polymers are within the skill in the art such as are discussed in the Encyclopedia of Polymer Science and Engineering, Vol. 3, pp. 363–380, ibid and in such references as U.S. Pat. No. 4,200,735 (Sano, et al.) wherein cellulosic ion exchange fibers are formed which have iminodiacetic acid groups.

Preferably, these polymers are cellulosic materials which have been derivatized to include sufficient chelating groups, preferably carboxylic acid groups, to form chelates, most preferably they are cellulosic materials which have been derivatized to include iminodiacetic acid derivatives.

Chelating materials are suitably prepared by reacting cellulosic materials with reactive derivatives, such as acid anhydrides or acid halides of compounds having chelating ligands such as diethylenetriaminepentaacetic acid (DTPA), ethylenediaminetetraacetic acid (EDTA), diethylenetriaminepentamethylenephosphonic acid (DTPMP), succinic acid, glutaric acid, phthalic acid, and the like. A reactive derivative is a derivative which is reactive with cellulose, generally with hydroxyl functionality thereon.

Reactions of cellulosic materials with reactive materials having chelating ligands is within the skill in the art. Cellulosic materials, such as wood pulp, have hydroxyl groups. Such hydroxyl groups are suitably reacted with other functional groups on a material having a chelating ligand or group convertible to a chelating ligand such that a chelating ligand is attached to the cellulosic material. Cellulose hydroxyl groups are, for instance, reactive with such groups as acid anhydrides to form ester groups through which a compound having a chelating ligand can be bound to a cellulose molecule such that a cellulosic material having a chelating ligand is formed. Such ester formation is within the skill in the art. In general, the anhydride or other reactive compound is heated to a temperature sufficiently high to result in formation of an ester between the cellulose hydroxyl groups and the reactive sites. reactions suitably take place under any conditions which result in the linking of the compound having chelating ligand(s) with the cellulosic material, preferably such that the chelating ligand is not undesirably deteriorated.

Advantageously preparation of cellulosic materials having chelating ligands optionally take place separately from the formation of cellulosic articles by the process of the invention. Alternatively preparation of cellulosic materials is adjunct to formation of the cellulosic articles, for instance, by reaction of part of the cellulosic material with compound(s) having chelating ligands, e.g. as a side stream of part of the cellulosic material or in situ.

Materials reactive with cellulose and having chelating ligands are commercially available or are formed from compounds having chelating ligands. For instance, a chelant having carboxyl groups such as EDTA, DTPA or NTA (nitrilotriacetic acid) is suitably contacted with acetic anhydride and pyridine to form an acid anhydride by methods within the skill in the art such as that disclosed by French Patent 1,548,888 (Geigy, 1968) (*Chem. Abstr.* 71(17):81380q) and Eckelmann, *J. Pharm. Sci.* 64, 704 (1975).

Alternatively, synthetic polymers having chelating groups, preferably carboxylic acid groups, such as copolymers of ethylene and acrylic acid or other copolymers or homopolymers of acrylic and/or methacrylic acid are suitably used. Such polymers are preferably ground or otherwise comminuted into fibrous or particulate form such that they are retained in a cellulosic pulp mass. Such synthetic polymers are prepared, for instance, by processes within the skill in the art such as disclosed by Vaughn et al. in U.S. Pat. Nos. 4,661,634; 4,747,954; 4,747,957; and 4,766,036, which are incorporated herein in their entireties, wherein ethylene acrylic acid fibers are chopped, swelled by reaction or digestion in base, then fibrillated by stress such as in a blender. Other suitable polymers include other water insoluble polymers with ability to bind metal ions, for instance derivatives of polystyrene suitable for cation exchange or binding such as sulfonate derivatives, insoluble acrylate polymers and other polymers including ion exchange resins having for instance sulfonate, carboxylate (carboxylic acid ester groups such as acrylate groups preferably having from 1 to about 20, more preferably from 1 to about 5 carbon atoms in the alcohol moiety) , phosphonate, or amine groups for metal ion exchange or binding.

Alternatively, inorganic retaining materials are useful in the practice of the invention. Such inorganic retaining materials include metal salt suspensions capable of binding metal ions in conditions found in making cellulosic articles like paper. Such metal salt suspensions are comprised of metal salts insoluble or slightly soluble in water. Preferred are salts of metals of Groups IIA, of the periodic table and Fe, Al, and Mn with anions with which these metals form insoluble or slightly soluble salts. Such anions include hydroxides, phosphates, oxides, carbonates, sulfates, and oxalates, preferably hydroxide and phosphate. More preferred metals include magnesium, calcium, iron and strontium. Suspensions are optionally preformed or preferably formed in situ by addition of an inorganic solid to an aqueous slurry.

Inorganic retaining materials also include mixed metal hydroxides (abbreviated MMH) capable of binding metal ions in conditions found in making cellulosic articles like paper. The expression "mixed metal hydroxide" implies that there are at least two different metals in the hydrous oxide crystals. The, advantageously crystalline, mixed metal hydroxides (MMH) used in the present invention have at least two metals, preferably of different valences. In the present invention, it is preferred that at least one of the metals is a trivalent metal, and is with at least one other metal which can be either, divalent or monovalent; alternatively both monovalent and divalent metals are optionally present. In addition to the hydroxide ion(s) there is optionally an amount of anion (or negative-valence radical) which substantially satisfies the valence requirements of the cations in the mixed metal hydroxide. The trivalent metal cation is preferably Al, Fe, Ga, or mixtures thereof; Al is most preferred as the trivalent metal. The divalent metal cation is preferably Mg, Ca, Mn, Fe, Co, Ni, Cu, Zn or mixtures thereof; Ca or Mg, especially Mg, is most preferred as the divalent metal. The monovalent metal is preferably Li.

Anion(s) can be monovalent, divalent, trivalent, or polyvalent, and are preferably selected from the group consisting of hydroxyl, halide, sulfate, nitrate, phosphate, carbonate, glycolate, lignosulfate, and polycarboxylic or negative-valence radicals. Thus, the anions can be inorganic or hydrophilic organic groups. Preferably anion(s) are inorganic.

The MMH compounds useful in the present invention are any within the skill in the art, more preferably those of the monodispersed, monolayer variety such as described in U.S. Pat. Nos. 4,664,843; S084,209; and 5,015,409; but the varieties disclosed in U.S. Pat. Nos. 4,477,367; 4,446,201; 4,392,979; 4,461,714; 4,990,268 and the like are also preferred. All of the patents listed in the previous sentence are hereby incorporated by reference in their entireties. The MMH compounds are prepared by processes disclosed in those references, advantageously by forming a solution of compounds of the subject metals under certain conditions whereby a soluble alkaline material, e.g. ammonia or caustic, reacts with the soluble metal compounds to produce the layered crystals of mixed metal hydroxides. However when it is best to avoid having ammonia in the product, another alkaline material, especially NaOH or KOH is used. The MMH may be used as a slurry of varied solids content, or dry.

The MMH disclosed in the above patents, can be represented by the formulae monodispersed crystalline mixed metal layered $$Li_mD_dT(OH)_{(m+2d+3+na)}A_a^n \cdot xH_2O \quad (I)$$

where m is an amount of Li of from zero to one;

D represents divalent metal ions;

d represents the amount of D ions in the range of zero to about 4;

T represents trivalent metal ions;

A represents at least one monovalent or polyvalent anion or negative-valence radical;

a is an amount of A ions of valence n, with na being an amount of from about zero to about −3;

where m+d is greater than zero, (m+2d+3+na) is equal to or greater than 3 and $xH_2O$ represents water of hydration with x being zero or more; crystalline layered $$Li_mD_fT(OH)_{(3+m+f)} \quad (II)$$

m, D, and T are as above;

f represents an amount of D of from 0 to 8.0; and (3+m+f) represents an amount of OH— ions which substantially satisfies the valence requirements of Li, D, and T, and where m+f does not equal zero; or crystalline $$MF_g^vZ_b^v \cdot pAl(OH)_3 \cdot xH_2O \quad (III)$$

where

M is at least one divalent metal selected from the group comprising Mg, Cu, Zn, Mn, Fe, Co, and Ni;

FZ represents negative valence ions or radicals selected from the group comprising hydroxyl, halide, inorganic acid, and organic acid;

p is a value of from 1 to about 4;

v is a negative valence of 1, 2, or 3;

g and b are each values of from zero to 2;

with (vg)+(vb) equal to 2, and with x being a value of zero or more with the proviso that when M is Mg, p is from about 1 to about 2; or crystalline Z layer $$LiX \cdot 2Al(OH)_3 \cdot xH_2O \quad (IV)$$

where

X is a halide and $xH_2O$-represents water of hydration with x being zero or more.

Preferred MMH for practice of the invention include those which have the formula $MgAi(OH)_5$ or $LiAl_2(OH)_7$, more preferably $MgAI(OH)_5$.

Any concentration effective to bind metal ions in a cellulose-containing or aqueous system is suitably used in the practice of the invention. These concentrations vary with the MMH material, how it is formed and how it relaxes or ages. For instance, those MMH materials prepared as dispersions rather than as solids are more active in the practice of the invention. A MMH dispersion is originally gelatinous, but as it ages it becomes more liquid and loses binding efficiency. Determining an appropriate concentration for use in the practice of the invention is within the skill in the art. It can be determined, for instance, by analyzing for unbound metal ions when concentrations of from about 5 to 100 grams of MMH per millimole of metal ion is used, with higher concentrations preferred if a soluble chelant is also present.

The mixed metal layered hydroxides, particularly $MgAi(OH)_5$, are preferred retaining agents because they bind both complexed (e.g. chelated with soluble chelating agents) and uncomplexed metal ions.

The amount of retaining material suitably used in the process of the invention is preferably sufficient to bind the metal cations to be controlled. Such an amount varies with the amount of metal cation present, the type of metal cation to be controlled or retained, and the activity of the retaining material with the metal cation(s) of interest. Determining suitable amounts from these parameters is within the skill in the art without undue experimentation. For instance, in processes involving peroxide bleaching of pulps, it is desirable to control manganese cations. Using a retaining material which binds iron more readily than manganese, one would use sufficient retaining material to bind any iron and any other cations more readily bound than manganese as well as the manganese. In reductive bleaching processes using bisulfite, however, it is important to control iron cations; then the retaining material would preferably be used in an amount sufficient to chelate the iron and any metals more readily chelated than the iron.

In the case of chelating agents or materials, an amount sufficient to chelate metal cations of a certain concentration is at least a stoichiometric amount, but varies with the stability constant of the chelating materials. The stability constant is recognized by those skilled in the art as a measurement of the stability of a chelate/ion combination or complex, therefore, a measurement of the activity of the chelant in chelating a type of metal ion. More equivalents of a material with relatively lower stability constant are required than of a material with a relatively higher stability constant to chelate the same concentration of a metal cation. The amount of chelant needed also varies with the metal ion affinity of the cellulosic material used to make the cellulosic article.

Some cellulosic materials absorb an amount of cations such that a chelant is not necessary for cations thus absorbed; then relatively less retaining material is needed. The amount of metal ion retained is also a function of the process used to make the pulp and the cellulosic article. While these factors result in varying amounts of retaining materials being sufficient or preferred for various situations, determining the amounts is within the skill in the art without undue experimentation. Examples of the invention also illustrate useful amounts and concentrations of retaining agents. Those skilled in the art are able to analyze for unbound metal and adjust concentrations of retaining agents to retain a preselected amount, preferably all or substantially all of the preselected metal ions in a cellulosic article. By substantially all is meant most of the metal ions of interest except for quantities incidentally in the separated liquid or quantities permitted by regulatory standards to be in the separated liquid (e.g. effluent, preferably water).

For instance, those skilled in the art will recognize that samples containing the metal ions to be retained with the cellulosic material and other materials are suitably tested by methods illustrated in the examples of the invention and other methods within the skill in the art. These methods involve using a series of concentrations of a retaining agent to determine how much of the metal ion is or is not retained in the cellulosic material. At least a 1:1 molar ratio of synthetic or cellulose derivative chelating material to metal ion to be bound is generally appropriate even though binding by the cellulosic material may reduce the requirement. To allow for differences in binding efficiency, additives that are optionally present, and variations with pH, amounts of from about stoichiometric ratios of chelating material to metal ion to molar ratios of about 300:1 are convenient for determining optimum concentrations. Excess chelating material is optionally used because unbound chelating material is not deleterious to the cellulosic articles made in the practice of the invention. In the same way, those skilled in the art can determine appropriate concentrations of colloidal suspensions and mixed metal hydroxides for use in the practice of the invention. Convenient trial ranges ratios of retaining material to metal ion to be bound are generally from about 10 g to about 100 g for the colloidal suspensions and from about 5 to about 100 g MMH per millimole of metal ion. From the results in these ranges those skilled in the art can determine effective ratios. Inorganic retaining materials in slight excess of the amount needed to bind the metal ions of interest are useful, but excesses sufficient to result in discoloration or to affect other physical characteristics of the cellulosic article are preferably avoided. While iron and/or manganese are often desirably controlled by practice of the invention, other metal cations are likewise similarly controlled including copper and other transition metals.

A low pH can interfere with activity of the retaining materials used in the practice of the invention. For instance, in organic retaining materials, a pH greater than the pKa of a chelating group is preferred to avoid protonation of the functional groups involved in chelating and consequent loss of chelating activity. When inorganic retaining materials are used, the pH is preferably at least high enough that solubilization of the retaining agent is not observed. When a low pH is desired, use of MMH retaining materials is generally advantageous because any pH at which the cellulosic material is not deteriorated is generally suitable for practice of the invention.

In addition to the cellulosic material, liquid in which cellulosic material (or pulp) is slurried and retaining agent useful in the practice of the invention, there may be present any additives within the state of the art for use in making cellulosic articles, particularly paper making. Such additives preferably however would not undesirably affect the retention of the metal ions in the paper by the retaining materials used in the practice of the invention. Chelating compounds having higher stability constants than the chelating or retaining materials used in the practice of the invention and retained in the cellulosic pulp material are, however, preferably avoided, except when mixed metal layered hydroxides are used as retaining agents, because such chelating compounds not retained in the pulp may preferentially chelate the metal ions, carrying them into solution, and thus reducing the amount of metal ion retained in the cellulosic article.

Because the retaining agents bind metal ions, they are useful as hydrogen peroxide stabilizers in alkaline bleaching of cellulosic articles such as paper. Transition metals such as manganese, iron, and copper promote decomposition of hydrogen peroxide. By binding these metals, the retaining agents stabilize the peroxide. The additives are preferably able to compete with the cellulosic material for binding of the metal ions. Such binding is preferably strong enough to prevent the metal ions from participating in degradation of the $H_2O_2$, if cellulosic material is to be bleached using an alkaline peroxide process.

The following examples are offered to illustrate but not limit the invention. Examples of the invention (Ex.) are designated numerically, while Comparative Examples (C. E.) or Comparative Samples (C.S.) which are not examples of the invention are designated alphabetically. All ratios, parts and percentages are by weight unless otherwise designated.

Examples 1.2 and Comparative Example A: Use of Ethyleneacrylic Acid Fibers to Chelate Metals A thermomechanical pulp (TMP) is used in a standard laboratory method for making paper under laboratory conditions (TAPPI method number T218 OS69 1969) to prepare three paper handsheets (test sheets of paper). Comparative Sample A is prepared from only the TMP pulp. Example 1 is prepared by using approximately six weight percent ethyleneacrylic acid (EAA) fibers and 94 weight percent TMP pulp. Example 2 is prepared using six weight percent EAA fibers which have been exposed to a 250 parts per million by weight (ppm) copper solution (cupric chloride in water) and 94 weight percent TMP pulp. The EAA fibers are prepared by caustic swelling (2 weight percent aqueous sodium hydroxide at a temperature of 50°–70° C.) followed by grinding a commercially available copolymer of 80 percent polyethylene and 20 percent acrylic acid commercially available from the Dow Chemical Company under the trade designation Primacor TM 5980. The copolymer has a nominal melt index of 200 and is ground to a size of 20–40 mesh (850–425 micron) size, using a Hammermill.

Brightness measurements are made on Comparative Example A and Example 1 using a brightness meter commercially available from Technidyne Corporation under the trade designation Brightmeter Model S-4 according manufacturer's directions. The brightness is reported in General Electric units (GE units). Comparative Example A has a brightness of 68.6 GE units, and Example 1 has a brightness of 68.4 GE units indicating that the fibers do not alter the brightness of the Example as compared to the Comparative Example not containing the EAA fiber.

Example 2, wherein the fibers are treated with copper, is observed to have bluish fibers randomly distributed throughout the paper. Such bluish fibers are not observed in Example 1 until a drop of the copper solution is placed on the paper. Then the bluish fibers are observed in the area where the copper solution is applied. These results indicate that the bluish fibers are fibers having copper associated therewith. Comparative Example A does not exhibit the bluish fibers, indicating that the EAA fibers are responsible for the bluish fibers. Thus, the EAA fibers are shown to result in the copper becoming associated with the paper.

Examples 3-5 and Comparative Example B: Use of Cellulose Treated with Diethylenetriamine Pentaacetic Acid (DTPA) Bis-anhydride to Absorb Metal Cations For each of Examples 3–5, 10 grams of Kraft pulp is slurried in 10 milliliters of dimethylsulfoxide (DMSO) and reacted with the amount of DTPA bis-anhydride indicated in Table 1. The reaction is allowed to proceed for the indicated amount of time at the temperature indicated in the Table. Each of Examples 3–5 is dispersed into about 450 milliliters of deionized water and made into a handsheet according to the procedure of TAPPI T218 OS69 (1969). For Comparative Example B, a handsheet is prepared by the same procedure using 10 g of Kraft pulp not treated with the DTPA bis-anhydride.

A solution of 220 milligrams of manganese chloride tetrahydrate is prepared in three liters of deionized water to make a solution of approximately 17.9 parts per million by weight.

With a drink mixer commercially available from Hamilton Beach/Scovil under the trade designation Model #936-2, each handsheet is then dispersed into 450 milliliters of the manganese solution for a period of three minutes after which it is vacuum filtered through Whatman #2 filter paper. The filtrate is analyzed for manganese using inductively coupled plasma spectroscopy (ICP), and the results are shown in Table I as parts per million by weight (ppm) manganese left in solution after removal of the pulp.

TABLE 1

| Example or Sample | DTPA-bis-Anhydride (g) | DMSO (ml) | Temp (°C.)/ Time (hours, hr) | Concentration Mn (ppm) in filtrate |
|---|---|---|---|---|
| C.E. B* | 0 | 0 | — | 11.8 |
| Ex. 3 | 0.1 | 10 | 60/1 hr | 10.6 |
| Ex. 4 | 0.5 | 10 | 60/1 hr | 5.8 |
| Ex. 5 | 0.5 | 10 | 25/1 hr. | 6.5 |

*Not an example of the invention.

These results indicate that using cellulose, treated to have chelating functionality thereon, in making paper results in less manganese in the solution filtered from the pulp. It is, however, noted that when excess reactant having chelating functionality is used, that portion of the reactant not reacted with cellulose can form a chelating agent in the solution; excess chelant in solution keeps metal cations chelated in solution rather than in the paper and increases, rather than decreases, the amount of metal in the solution. Thus, use of an amount of such a reactant in excess of that sufficient to react with the cellulose present is disadvantageous for reducing the concentration of metal cations in the separated solution. The amount is readily ascertainable by noting an increase of metal in the solution.

When a procedures similar to that used in Examples 3–5 is used with EDTA bis-anhydride, less effectiveness is observed than with DTPA bis-anhydride in these Examples. This observation is believed to indicate that the reaction of EDTA bis-anhydride with cellulose is less facile than the corresponding reaction with DTPA bis-anhydride.

Comparative Example D: Use of Untreated Cellulose Pulp

A paper handsheet is prepared from 10 grams of Kraft pulp (that is a pulp which is digested in sodium hydroxide and sodium sulfide in a sulfate process) according to the procedures of TAPPI T218 OS69 (1969).

A manganese solution is prepared by dissolving 0.78 grams of manganese chloride ($MnCl_2$) in two liters of deionized water. The handsheet is dispersed in 450 milliliters of this solution, which is approximately 11 ppm (parts per million by weight) manganese by the procedure used in Example 3, except that blending is continued for 2 minutes. The manganese in the solution separated from the pulp by filtration through Whatman #12 is measured by inductively coupled plasma spectroscopy (ICP) and found to be 2.9 ppm manganese, indicating that the pulp retains some manganese even when not treated with a chelating agent.

Example 6: Use of Cellulose Treated with DTPA Bis-anhydride

A sample of 0.5 grams of DTPA bis-anhydride is dissolved in 10 milliliters of DMSO and used to saturate 10 grams of Kraft pulp. The saturated pulp is placed in an oven for 20 minutes at 140° C. and made into a handsheet by the procedure of Comparative Example D. Also by the procedure of Example D, the handsheet is dispersed 450 milliliters of the manganese solution for two minutes and filtered from the solution. The liltrate has 1.8 parts per million of manganese, indicating that use of a chelant treated cellulose (a cellulosic retaining agent) results in a reduction of metal cation in the separated solution.

Example 7: Use of Ethyleneacrylic Acid Polymer to Retain Metal Cations

A sample of 50 grams of a 25 weight percent solids dispersion of ethyleneacrylic acid copolymer having 20 percent ethyleneacrylic acid and 80 percent ethylene (Commercially available from the Dow Chemical Company under the trade designation Primacor TM 4983) is mixed with 10 grams of Kraft pulp. A handsheet is prepared according to the procedure of TAPPI T218 OS69 (1969), dispersed in 450 milliliters of manganese solution described in Comparative Example D, filtered according to the procedure of Comparative Example D and found to have 0.6 ppm manganese, indicating that use of a chelating polymer in making a cellulosic article results in less manganese in a separated solution than is observed when untreated cellulose or cellulose treated with methylol DTPA adduct is used.

Examples 8–9 and Comparative Examples E and F: Use of Ethylene Acrylic Acid Polymer For Examples 8 and 9, commercial dispersions of ethyleneacrylic acid (EAA) are used as in Example 7 to prepare handsheets which are subsequently ground and dispersed in a manganese solution which is 19.0 ppm manganese and filtered by the same procedure. Manganese concentration is measured by the same procedure and reported in Table 2.

Comparative Example E is prepared by the procedure used for Examples 8–9, except that no EAA polymer is used. The Comparative Example is treated with manganese solution and measured as for the Examples. Results are in Table 2.

TABLE 2

| Run | Additive *** | Weight of additive | Solvent | Mn ppm** remaining in filtrate |
|---|---|---|---|---|
| C.E. E* | None | none | Water | 12.0 |
| Ex. 8 | EAA 20% AA 25% Solids | 0.5 g (active) (2.0 g polymer) | Water | 10.0 |
| Ex. 9 | EAA 20% AA 25% Solids | 1.0 g (active) (4.0 g polymer) | Water | 9.3 |

*Not an example of the invention.
**A stock solution of 19.0 ppm manganese prepared from manganese (II) chloride and deionized water is used.
***EAA is Ethylene acrylic acid polymer; AA is Acrylic.

The results in Table 2 show that EAA is effective in retaining manganese such that it does not go into the solution separated from cellulosic material in the making of a cellulosic article.

Examples 10–17 and Comparative Sample F: Effectiveness of Inorganic. Colloidal Suspension Iron and manganese standards are obtained at concentrations of 996 parts per million (ppm) and 999 ppm, respectively. A 2.5 ml sample of each is transferred to a 1000 ml volumetric flask. The flask is filled to approximately 10 ml above volume (1010 ml total) with deionized (DI) water, and the resulting solution is mixed thoroughly. The procedure listed below is followed for each of the additives evaluated. Two samples of each compound are used. The weight for each sample is listed in Table 3 with the results of each measurement.

Experimental procedure:

1. 100 ml of the standard stock solution, a magnetic stirrer, and the indicated weighed amount of each additive (as a solid) are added to a large beaker.
2. The mixture is stirred slowly for 7 minutes (min.) (420 s) during which time the solid forms a colloidal suspension.
3. The mixtures are then filtered through Whatman #1 filter paper to simulate retention in a cellulosic article. The remainder of the stock solution (10 ml) is also filtered to serve as C.S. F
4. The filtrates are analyzed by Inductively Coupled Plasma (ICP) atomic emission spectroscopy to determine the amount of iron and manganese left in solution. Results of the analysis are in Table 3.

TABLE 3

| Example or Sample | Additive | Weight of Additive | Fe ions in filtrate (ppm) | Mn ions in filtrate (ppm) |
|---|---|---|---|---|
| C.S. F* | Control, no retaining material | 0 | 2.354 | 2.692 |
| Ex. 10 | $Mg(OH)_2$ | 0.500 g | 0.013 | ND** |
| Ex. 11 | $Mg(OH)_2$ | 0.257 g | 0.012 | 0.006 |
| Ex. 12 | $Ca(OH)_2$ | 0.496 g | 0.285 | 0.245 |
| Ex. 13 | $CA(OH)_2$ | 0.259 g | 0.201 | 0.182 |
| Ex. 14 | CaO | 0.500 g | 0.066 | 0.055 |
| Ex. 15 | CaO | 0.250 g | 0.096 | 0.088 |
| Ex. 16 | $Sr(OH)_2—8H_2O$ | 0.507 g | 0.087 | 0.094 |
| Ex. 17 | $Sr(OH)_2—8H_2O$ | 0.264 g | 0.125 | 0.123 |

*Not an example of the invention.
**ND = none detected (measured value less than noise).

The data in Table 3 shows that when inorganic materials which form suspensions are added to solutions of manganese and iron ions, they effectively separate Fe and Mn ions from the aqueous solutions. The suspensions and associated metal ions can then be removed with cellulosic pulp by filtration.

Examples 18–21 and Comparative Sample G; Use of Mixed Metal Hydroxides as Retaining Agents Samples of 2.5 mL of each of the iron and manganese standards used in Example 10 are transferred to a 1000 ml volumetric flask. The flask is filled to volume with deionized (DI) water, and the solution is mixed thoroughly. A 0.4 weight percent solution of DTPA in DI water is prepared by diluting a 40 percent stock solution of DTPA 1 to 100 by weight. The procedure listed below is followed for each additive. The weight for each example and the corresponding volume of DTPA added is listed in Table 4 along with the results of each measurement.

Experimental procedure:

1. A sample of 100 ml of the standard stock solution, a magnetic stirrer, and a volume of DTPA as listed in Table 4 are added to a large beaker. The solution is mixed thoroughly for 5 minutes.
2. The mixed metal aluminum hydroxide, $MgAl(OH)_5$ (MMH, prepared as described in U.S. Pat. No. 4,664,843 which is incorporated herein in its entirety) in a 10 weight percent suspension in water is added to the beaker and the mixture is stirred slowly for 10 min. The amounts added are indicated in Table 4 and are measured by active weight, that is the amount in the table is the amount of $MgAi(OH)_5$ rather than the weight of solution containing it.
3. The mixtures are then filtered through Whatman #1 filter paper to simulate retention in a handsheet. A portion of the stock solution is also filtered to serve as a control (C.S. G).
4. The amount of iron and manganese left in solution is determined by Inductively Coupled Plasma (ICP) atomic emission spectroscopy and the percent of iron and manganese removed from solution are determined by comparison with C.S. G (as 0 percent removed).

TABLE 4

| Example or Sample No. | Additive | Weight of Additive | molar ratio of ligand to metal** | mMoles of DTPA*** in solution | Percent removed from solution for C.S. G Fe | Mn |
|---|---|---|---|---|---|---|
| C. S. G | (Control) | 0.00 g | — | 0.000 | (0.0041) ** | (0.0048) ** |
| Ex. 18 | $MgAl(OH)_5$ | 0.372 g | — | 0.000 | 98.8 | 98.4 |
| Ex. 19 | $MgAl(OH)_5$ | 0.378 g | 1:2 | 0.005 | 99.9 | 99.0 |
| Ex. 20 | $MgAl(OH)_5$ | 0.374 g | 1:1 | 0.010 | 100 | 98.6 |
| Ex. 21 | $MgAl(OH)_5$ | 0.380 g | 5:2 | 0.025 | 100 | 99.4 |

*Not an example of the invention.
**mMoles in solution, zero percent removed
***DTPA is diethylenetriaminepentaacetic acid
****Ligand is the additive; metal is the metal cation in solution The data in Table 4 shows that $MgAl(OH)_5$ (a mixed metal hydroxide) is an effective retaining agent for retaining iron and manganese ions even in the presence of a soluble chelating agent.

Examples 22–25 and: Use of Mixed Metal Hydroxides as Retaining Agents

The procedure of Example 18 is repeated using 0.35 grams of $LiAl_2(OH)_7$ for each example in place of the $MgAl(OH)_5$ and using the amount of DTPA indicated in Table 5 for each example with the results shown in Table 5. It is noted that the filtration is faster for $LiAl_2(OH)_7$ than for $MgAi(OH)_5$.

TABLE 5

| Example or Sample No. | Additive | Weight of Additive | molar ratio of Ligand to metal**** | nMoles of DTPA*** in solution | Percent removed from solution Fe | Mn |
|---|---|---|---|---|---|---|
| Ex. 22 | $LiAl_2(OH)_7$ | 0.35 g | — | 0.000 | 98.6 | 99.2 |
| Ex. 23 | $LiAl_2(OH)_7$ | 0.35 g | 1:2 | 0.005 | 95.3 | 95.0 |
| Ex. 24 | $LiAl_2(OH)_7$ | 0.35 g | 1:1 | 0.010 | 70.7 | 43.8 |
| Ex. 25 | $LiAl_2(OH)_7$ | 0.35 g | 5:2 | 0.025 | 10.9 | 33.0 |

*Not an example of the invention.
**mMoles in solution, zero percent removed
***DTPA is diethylenetriaminepentaacetic acid
****Ligand is the additive; and metal is the metal cation in solution.

The data in Table 5 shows that $LiAl_2(OH)_7$ (a mixed metal hydroxide) is an effective retaining agent for retaining iron and manganese ions even in the presence of a soluble chelating agent, but in comparison with the data in Table 4 shows it to be less effective than $MgAl(OH)_5$in the presence of the soluble chelating agent.

What is claimed is:

1. An improvement in a process for making cellulosic articles said process involving a separation of cellulosic materials from a mixture containing a liquid, metal cations, and cellulosic material, the improvement comprising admixing with the mixture at least one retaining material which binds at least one metal cation and, in the separation, is retained with the cellulosic material wherein the retaining material is a mixed metal hydroxide of one or more of the following formulae:

monodispersed crystalline mixed metal layered $$Li_mD_dT(OH)(m+2d+na)^{4}a^{n}\cdot H_2O \quad (I)$$

where m is an amount of Li of from zero to one;

D represents divalent metal ions of the group consisting of Mg, Ca, Mn, Fe, Co, Ni, Cu, and Zn;

d represents the amount of D ions in the range of zero to about 4;

T represents trivalent metal ions selected from the group consisting of Al, Ga, Fe, and Cr;

A represents at least one monovalent or polyvalent anion or negative-valence radical;

a is an amount of A ions of valence n, with na being an amount of from about zero to about −3;

where m+d is greater than zero, (m+2d+3+na) is equal to or greater than 3 and $xH_2O$ represents water of hydration with x being zero or more; crystalline layered $$Li_mD_fT(OH)(3+m+f) \quad (II)$$

m, D, and T are as above;

f represents an amount of D of from 0 to 8.0; and (3+m+f) represents an amount of OH— ions which substantially satisfies the valence requirements of Li, Dr and T, and where m+f does not equal zero; or crystalline $$MF_g^vZ_b^v\cdot pAl(OH)_3\cdot xH_2O \quad (III)$$

where

M is at least one divalent metal selected from the group consisting of Mg, Cu, Zn, Mn, Fe, Co, and Ni;

FZ represents negative valence ions or radicals selected from the group consisting of hydroxyl, halide, inorganic acid, and organic acid;

p is a value of from 1 to about 4;

v is a negative valence of 1, 2, or 3;

g and b are each values of from zero to 2;

with (vg)+(vb) equal to 2, and with x being a value of zero or more with the proviso that when M is Mg, p is from about 1 to about 2; or crystalline Z layer $$LiX \cdot 2Al(OH)_3 \cdot xH_2O \quad (IV)$$

where

X is a halide and $xH_2O$ represents water of hydration with x being zero or more.

2. The process of claim 1 wherein the divalent metal is selected from the group consisting of Mg, Ca, Mn, Fe, Co, Ni, Cu, Zn and combinations thereof or the monovalent metal is Li.

3. The process of claim 2 wherein the divalent metal is Ca, Mg or a combination thereof.

4. The process of claim 3 wherein the trivalent metal is Al, Fe, Ga, or a combination thereof.

5. The process of claim 4 wherein the trivalent metal is Al.

6. The process of claim 1 wherein the trivalent metal is Al and the other metal is Li, Ca, Mg or a combination thereof.

7. The process of claim 1 wherein the mixed metal hydroxide is $MgAl(OH)_5$.

8. The process of claim 1 wherein the mixed metal hydroxide is $LiAl_2(OH)_7$.

9. The process of claim 1 wherein the mixed metal hydroxide is a crystalline monodispersed, monolayer mixed metal hydroxide.

10. The process of claim 1 wherein at least a portion of the metal ions are chelated with a soluble chelating agent before contact with the mixed metal hydroxide.

11. A cellulosic article comprising cellulosic material and at least one retaining material wherein the retaining material is a mixed metal hydroxide of one or more of the following formulae: monodispersed crystalline mixed metal layered $$Li_mD_dT(OH)(m+2d+3+na)^4a^n \cdot xH_2O \quad (I)$$

where m is an amount of Li of from zero to one;

D represents divalent metal ions of selected from the group consisting of Mg, Ca, Mn, Fe, Co, Ni, Cu, and Zn;

d represents the amount of D ions in the range of zero to about 4;

T represents trivalent metal ions selected from the group consisting of Al, Ga, Fe, and Cr;

A represents at least one monovalent or polyvalent anion or negative-valence radical;

a is an amount of A ions of valence n, with na being an amount of from about zero to about −3;

where (m+2d+3+na) is equal to or greater than 3 and $xH_2O$ represents water of hydration with x being zero or more; crystalline layered $$Li_mD_fT(OH)(3+m+f) \quad (II)$$

m, D, and T are as above;

f represents an amount of D of from 0 to 8.0; and (3+m+f) represents an amount of OH— ions which substantially satisfies the valence requirements of Li, D, and T, and where m+f does not equal zero; or crsytalline $$MF_g^vZ_b^v \cdot pAl(OH)_3 \cdot xH_2O \quad (III)$$

where

M is at least one divalent metal selected from the group consisting of Mg, Cu, Zn, Mn, Fe, Co, and Ni;

FZ represents negative valence ions or radicals selected from the group consisting of hydroxyl, halide, inorganic acid, and organic acid;

p is a value of from 1 to about 4;

v is a negative valence of 1, 2,or 3;

g and b are each values of from zero to 2;

with (vg)+(vb) equal to 2, and with x being a value of zero or more with the proviso that when M is Mg, p is from about 1 to about 2; or crystalline Z layer $$LiX \cdot 2Al(OH)_3 \cdot xH_2O \quad (IV)$$

where

X is a halide and $xH_2O$ represents water of hydration with x being zero or more having at least one trivalent metal and at least one divalent or monovalent metal.

* * * * *

UNITED STATES PATENT AND TRADEMARK OFFICE

CERTIFICATE OF CORRECTION

PATENT NO. : 5,447,603

DATED : September 5, 1995

INVENTOR(S) : Robert J. Michalowski et al.

It is certified that error appears in the above-identified patent and that said Letters Patent is hereby corrected as shown below:

In column 15, claim 1, between lines 61-65, "$Li_mD_dT(OH)(m+2d+na)^Aa^n \cdot H_2O$" should read $Li_mD_dT(OH)(m+2d+3+na)A_a^n \cdot xH_2O$ (I)

In column 16, claim 1, on line 50, "Li, Dr and T, and where m+f does not equal zero;" should read -- Li, D, and T, and where m+f does not equal zero; --.

In column 16, claim 1, on line 67, "Mg, p is from about 1 to about 2; or crystalline Z" should read -- Mg, p is from about 1 to about 2; or crystalline 2 --.

Signed and Sealed this

First Day of April, 1997

Bruce Lehman

*Attest:*

BRUCE LEHMAN

*Attesting Officer*

*Commissioner of Patents and Trademarks*